United States Patent [19]

Gaul et al.

[11] Patent Number: 4,684,038

[45] Date of Patent: Aug. 4, 1987

[54] DEVICE FOR TAPPING CONTAINERS FILLED WITH LIQUID

[75] Inventors: Herr K. Gaul, Kirchardt; Herr J. Mogler; Herr H. Wiedmann, both of Heilbronn, all of Fed. Rep. of Germany

[73] Assignee: Gebruder Mogler GmbH & Co., Fed. Rep. of Germany

[21] Appl. No.: 746,973

[22] Filed: Jun. 20, 1985

[30] Foreign Application Priority Data

Aug. 10, 1984 [DE] Fed. Rep. of Germany ..... 3429559

[51] Int. Cl.[4] ..... B67B 7/50

[52] U.S. Cl. ..... 222/89; 222/83; 222/473; 222/475; 30/445; 30/450

[58] Field of Search ..... 222/81, 83, 89, 469, 222/473, 475, 470, 80, 83.5, 85, 86, 88; 220/85 D, 94 R, 96, 85 H; 30/445, 446, 450

[56] References Cited

U.S. PATENT DOCUMENTS

| | | | |
|---|---|---|---|
| 577,462 | 2/1897 | Stewart | 222/83 |
| 1,072,588 | 9/1913 | Duncan | 222/83.5 X |
| 1,113,270 | 10/1914 | Werner | 222/83.5 |
| 1,245,333 | 11/1917 | Goldberg | 222/83 |
| 1,265,435 | 5/1918 | Davis | 222/88 X |
| 2,024,208 | 12/1935 | Deschner | 222/83 X |
| 2,091,737 | 8/1937 | Longway | 222/89 X |
| 2,246,693 | 6/1941 | Ohme | 222/83.5 |
| 2,384,206 | 9/1945 | Stow | 222/88 |
| 3,014,621 | 12/1961 | Povitz | 222/475 X |
| 3,519,167 | 7/1970 | Rast | 222/82 |

FOREIGN PATENT DOCUMENTS

| | | |
|---|---|---|
| 1909077 | 9/1970 | Fed. Rep. of Germany . |
| 2531697 | 2/1977 | Fed. Rep. of Germany . |
| 2106879 | 4/1983 | United Kingdom . |

*Primary Examiner*—Joseph J. Rolla
*Assistant Examiner*—Nils Pedersen
*Attorney, Agent, or Firm*—Pahl, Lorusso & Loud

[57] ABSTRACT

Device for tapping containers filled with liquid, in particular, tin cans filled with beer, with a mounting for fixing the device relative to the container, with a tubular piercing member sharpened at the front which penetrates the wall of the container, with a tap arranged on the tubular piercing member, and with a sealing collar enclosing the tubular piercing member and abutting against the container wall. The tubular piercing member is immovably connected to the mounting, and, when the latter is positioned on the container, penetrates the container wall. The sealing collar protrudes beyond the cutting rim of the tubular piercing member so that when the device is fixed on the container, the sealing collar abuts against it sealingly before the tubular piercing member penetrates the container wall.

6 Claims, 5 Drawing Figures

DEVICE FOR TAPPING CONTAINERS FILLED WITH LIQUID

The invention relates to a device for tapping containers filled with liquid, in particular, tin cans filled with beer, with a mounting for fixing the device relative to the container, with a tubular piercing member sharpened at the front which penetrates the wall of the container, with a tap arranged on the tubular piercing member, and with a sealed collar enclosing the tubular piercing member and abutting against the container wall.

In a known device of this kind (U.S. Pat. No. 2,246,693), the tubular piercing member is arranged for displacement in the mounting. Following insertion of the container to be tapped into the mounting, the tubular piercing member must be pushed forward relative to the stationary mounting until it punctures the container wall. This necessitates a special advancing mechanism. The sealing collar of the known device is, likewise in relation to the mounting, not stationary, but rather displaceable relative to the latter against spring pressure. Altogether, the known device is therefore comprised of several single parts, complicated to manufacture, susceptible to failure and not readily operable by laymen.

The object underlying the invention is to so improve a device of the generic kind that with simple manufacturability and reliable operation it may be easily used, also by laymen, for tapping a container, in particular, a tin can filled with beer.

The object is attained in accordance with the invention in that the tubular piercing member is immovably connected to the mounting, and, when the latter is positioned on the container, penetrates the container wall, and in that the sealing collar protrudes beyond the cutting rim of the tubular piercing member so that when the device is fixed on the container, the sealing collar abuts against it sealingly before the tubular piercing member penetrates the container wall.

The following description of a preferred embodiment serves in conjunction with the appended drawings to explain the invention in greater detail.

Figure 4:
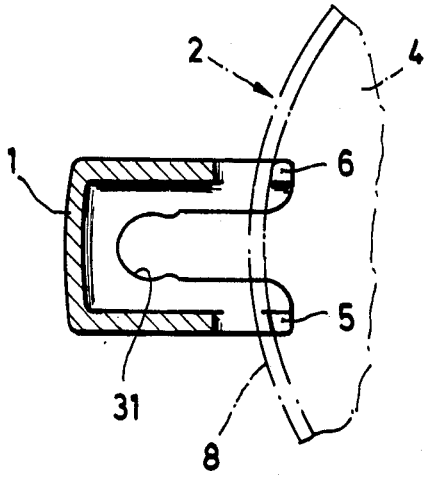
FIG. 4 is an isolated sectional view.

As is apparent from the drawings, a device for tapping containers filled with liquid, in particular, liquids under pressure, for example, tin cans filled with beer, comprises as mounting a one-armed lever 1 of substantially U-shaped cross-section (FIG. 4). The length of the lever 1 corresponds substantially to the height of a tin can 2 whose shell 3 is to be punctured immediately above the container base 4 located at the bottom. The lever 1 comprises in the area of its bottom end two claws 5, 6 bent inwardly at right angles towards the container base 4 and acting as swivel or rotary bearing for the lever 1 (FIG. 4). With these claws, the lever is hung into a recessed flange rim 7 between the container shell and the container base 4, with the outer rim edge 8 forming a kind of swivel axis for the lever 1.

At its end opposite to the claws 5, 6, the lever 1 comprises at least one detent notch 9 which is spaced from the claws 5, 6 at such a distance as is required to bridge the casing of the container 2. In the area of its end adjacent to the detent notch 9, the lever 1 is of slightly elastic configuration, so that the detent notch 9 is detainable at the edge 10 of the flange rim 11 at the upper container base 12. To facilitate the detention and, consequently, the fixing of the lever 1 on the container 2, it is of elastic design in the area of its end adjacent to the detent notch 9. In the embodiment shown, this is achieved by this area of the lever 1 being of relatively thin configuration and taking the form of a handle 13 at which the lever may be comfortably gripped and swivelled.

As illustrated, the lever 1 comprises a main section 14 which extends substantially vertically at the container 2 to be opened, and from which there protrude substantially perpendicularly towards the container 2, two sections 15, 16, with the claws 5, 6 and the detent notch 9, respectively, arranged thereon.

Rigidly connected to the lever 1 (FIG. 3) and protruding towards the container 2 is a tubular piercing member 17 whose front or free rim is sharpened to facilitate puncturing of the container wall (shell 3). Likewise rigidly connected to the lever 1 and enclosing the tubular piercing member 17 is a sealing collar 18 made of rubber elastic material whose cross-sectional shape is apparent from FIG. 3. As illustrated, a free rim 19 of the sealing collar 18 protrudes slightly beyond the front end of the tubular piercing member 17 so that when the lever 1 is placed against the container 2, i.e., prior to the actual tapping procedure, the sealing collar 18 always abuts against the outside of the container shell 3 sealingly before the tubular piercing member 17 comes into contact with the shell. In this way, liquid is reliably prevented from flowing or spurting out of the container into the open during the tapping procedure.

There is furthermore arranged on the end of the lever 1 carrying the tubular piercing member 17 a tap 21 which is connected to the tubular piercing member and consists of the following single parts:

An outlet tube 22 in flow connection with the inside of the tubular piercing member 17, a displaceable plug 24 subject to the load of a spring 23, with a sealing disc 25, an axis 26 protruding from the plug 24, and a tap lever 28 resting swivably on an edge 27 and engaging the axis 26. When the tap lever 28 is swivelled (in the clockwise direction in FIG. 3), the sealing disc 25 of the plug 24 is raised from its seat so that liquid may flow from the tubular piercing member 17 into the outlet 22 and from there into a glass or the like.

Figure 1:
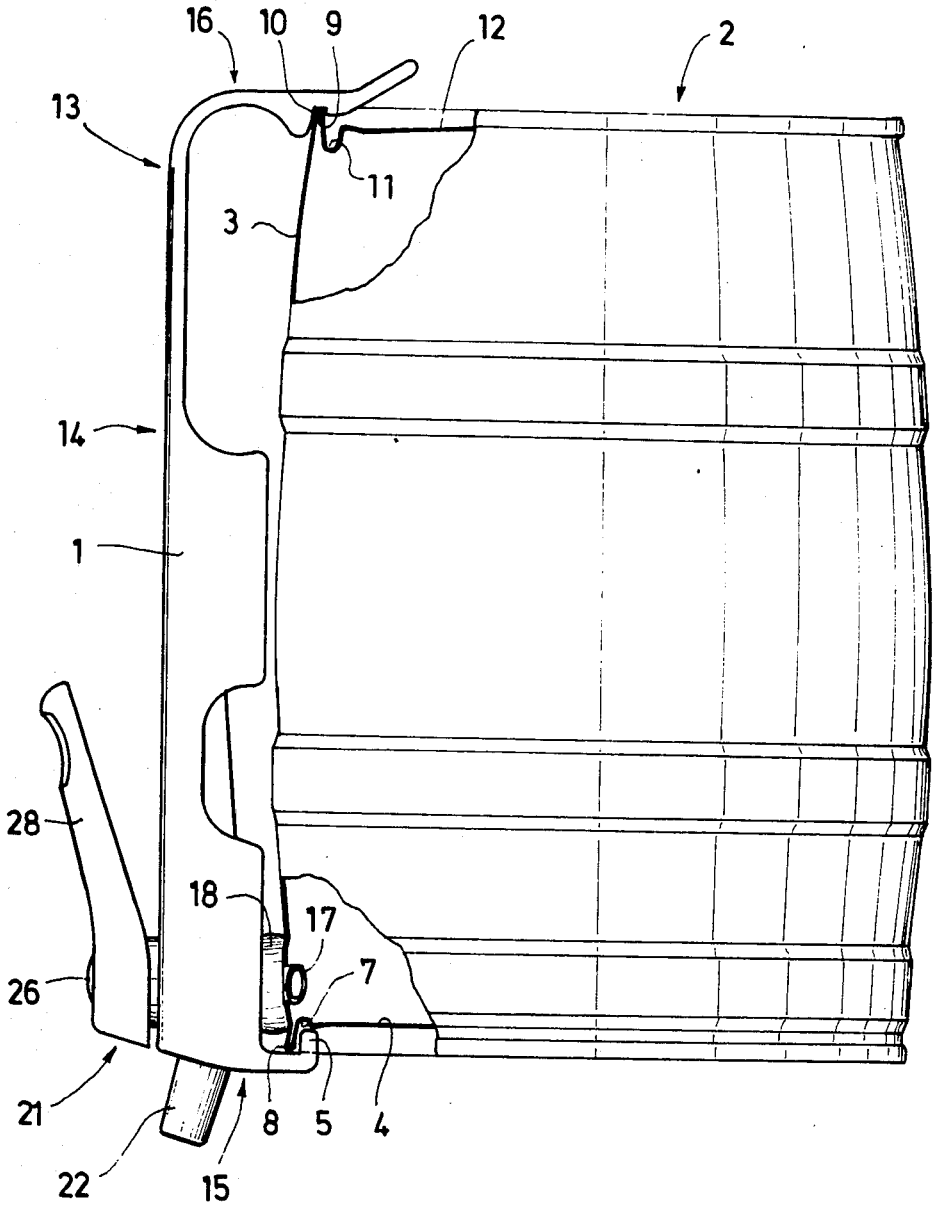
FIG. 1 is a side view of a tin can with the tapping device.

The mode of operation with the device described is as follows:

The lever 1 is hung with the claws 5, 6 into the rim edge 8 of the lower flange rim 7, thereupon swivelled (in the clockwise direction) into the position shown in FIG. 1 and detained with the detent notch 9 at the edge 10 of the upper flange rim 11. The front rim of the sealing collar 18 first positions itself sealingly against the outside of the container shell 3, and the sharp rim of the tubular piercing member 17 then punctures the container wall to enable liquid to flow out of the container interior into the tubular piercing member 17. On actuating the tap lever 28 in the above described manner, the liquid may then exit via the outlet 22. The essential advantage of the device described lies in the simple rigid arrangement of piercing member 17 and sealing collar 18 on the lever 1 acting as mounting, and in that the front rim 19 of the sealing collar 18 protrudes beyond the cutting rim of the tubular piercing member 17 so that when the lever 1 is placed against the container 2, a sealing first occurs, and only after this is the container wall penetrated by the piercing member.

These advantages are also obtainable if the mounting of tubular piercing member 17 and sealing collar 18 is not in the form of a swivel lever, but of different design. More particularly, the mounting could also be in the form of a clamping bracket peripherally enclosing the container 2 entirely or partially. When it is clamped in the proximity of the lower container base 4, the piercing member 17 rigidly arranged on the bracket penetrates the container wall, again after sealing has previously been effected by means of the sealing collar 18. Such a clamping bracket may also advantageously be in the form of an elastic clamping band. Other mountings have also proven to be expedient so that the invention is insofar not limited to the mounting being in the form of a lever.

For tapping purposes, the container is positioned on a table or another base in such a way that the place on the container rim carrying the claws 5, 6 and, consequently, also the outlet 22 protrude beyond the edge of the table or the base to enable a glass or the like to be positioned at the outlet.

Figure 3:
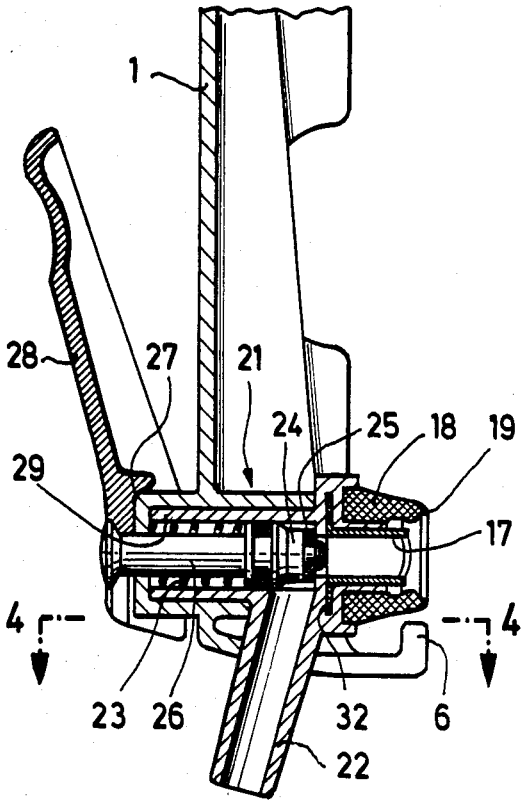
FIG. 3 is an enlarged sectional illustration of a piercing member with a sealing collar and a tap.

As shown in FIG. 3, it is particularly expedient to arrange the tap 21 with outlet 22, the tubular piercing member 17 and the sealing collar 18 on an insert 29, more particularly, an injection molded part made of plastic, to manufacture this part separately and to subsequently insert it into the end of the lever 1 carrying the claws 5, 6, with the outlet 22 snapping into a corresponding recess 31 in the lever 1 and thereby firmly connecting lever 1 and insert 29 with one another. As illustrated, the tubular piercing member 17 comprises a flange-type extension 32, with which it is anchored by extrusion coating in the insert 29. The sealing collar 18 is inserted into a corresponding annular groove of the insert 29. Also arranged for displacement in the insert 29 is the plug 24 with the axis 26, and the insert furthermore comprises the abutment surface for the sealing disc 25.

Figure 5:
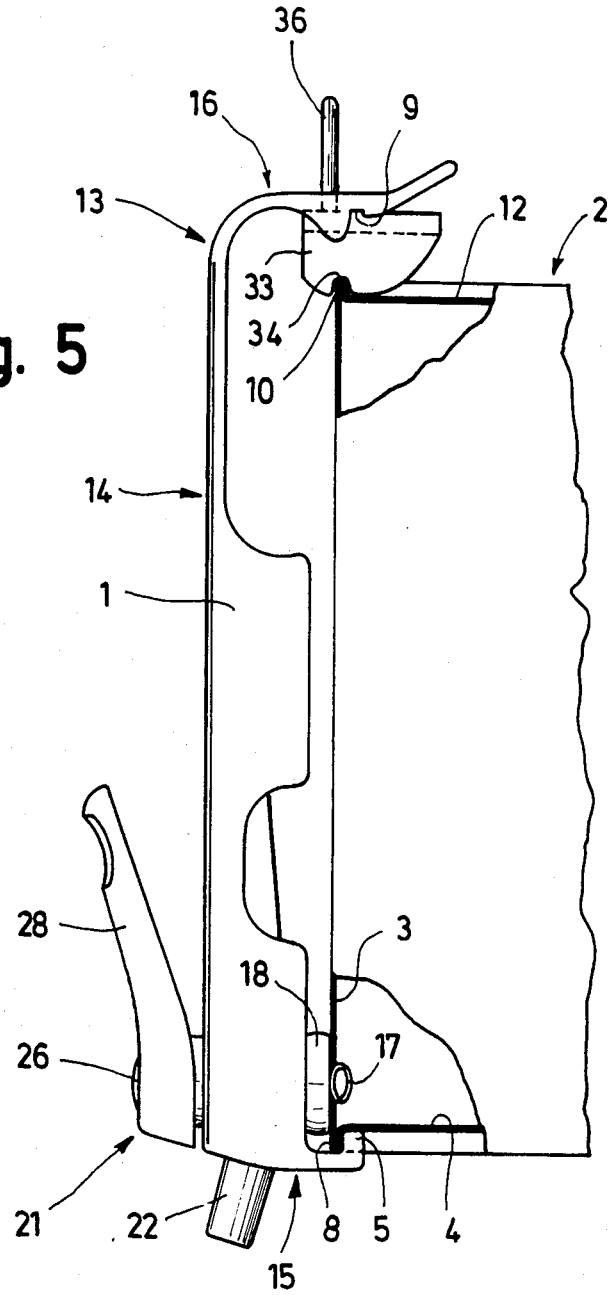
FIG. 5 is a view similar to FIG. 1 with a modified device for tapping smaller containers.

Containers of the kind illustrated in FIG. 1 of different heights, depending on the volume, are commonly found on the market. To enable use, i.e., positioning and detention of one and the same lever on containers of different heights, there is provided, in accordance with the invention, an adapter or spacer with whose aid the effective spacing between the claws 5, 6 and the detent notch 9 on the lever 1 may be reduced. This is illustrated in FIG. 5. The spacer 33 is positioned or pushed in a known manner onto the part 16 of the lever 1 carrying the detent notch 9 or releasably attached there in another way. The spacer 35 comprises a detent notch 34 which in the operating position is located beneath the detent notch 9 by an amount equivalent to the difference between the heights of various containers 2. After mounting of the spacer 33, the lever 1 may therefore also be used for tapping smaller containers than shown in FIG. 1.

Figure 2:
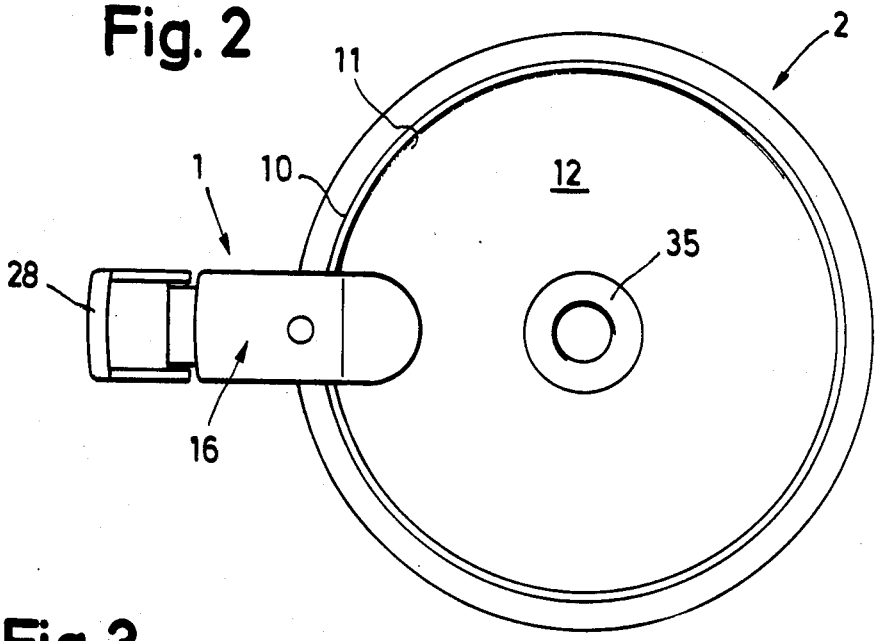
FIG. 2 is a top view of the arrangement shown in FIG. 1.

In order to ensure that the container 2 is completely emptied of the liquid contained therein, it is necessary, particularly if the liquids are not under pressure, to make an opening in the upper area of the container to enable the atmospheric pressure to act upon the liquid stored in the container. The commercial beer cans made of tin comprise on the upper container base 12 a bung-hole via which the container is filled. Upon completion of the filling, the bung-hold is sealed with a plug-type bung-hole closure consisting of rubber or the like, which is indicated in FIG. 2 by the reference numeral 35 and comprises on the inside a diaphragm-type transverse wall which can be easily punctured with an appropriate appliance, for example, a dagger or the like. When the diaphragm has been punctured, atmospheric pressure can spread out in the container 2 above the liquid level and cause the remainder of the liquid to flow out. Instead of a puncturable diaphragm, an inner core which may be pressed into the container can also be arranged in the bung-hole closure 35.

A further embodiment of the invention is characterized by the feature that there is additionally arranged on the aforementioned spacer 33, an aerating spike 36 which, if necessary, may be used to puncture the aforementioned diaphragm of the bung-hole closure 35 or to press in the inner core. The aerating spike 36 may be rigidly or also releasably connected to the spacer 33. The aerating spike 36 may also have a sharp tip which enables direct puncturing of the container wall, in particular, the upper container base 12.

What is claimed is:

1. A device for tapping a side surface of tin cans having a lower base, an upper base, a vaulted shell connecting said lower and upper base as well as recessed flange rims between the shell and the lower and upper bases, respectively, said cans being filled with beer under pressure, said device comprising:

a mounting in the form of a one-armed lever to be connected with the can, the length of said lever corresponding substantially to the height of said can, said lever including:

a main section extending substantially vertically at said shell, a lower section protruding in the same substantially vertical direction as said main section from the lower end of said main section toward said lower base, and an upper section protruding in the same substantially vertical direction as said main section from the upper end of said main section toward said upper base of said can, said upper section being elastically connected with said main section, at least one claw on said lower section to connect said lever pivotally with said flange rim between the lower base and the shell of the can, at least one detent notch at the end of said upper section for detainably fixing said lever at said flange rin between the upper base and the shell of the can, a tubular piercing member having a sharpened cutting rim and being immovably connected to said lower section of said lever and adapted to penetrate said shell near the flange rim between said lower base and said shell when said lever is positioned on said can, a sealing collar being immovable with respect to and enclosing said tubular piercing member and protruding beyond said cutting rim of said tubular piercing member so that when the lever is fixed on the can the sealing collar abuts against the shell of the can sealingly while being compressed before the tubular piercing member penetrates said shell, and a tap provided on said lower section of said lever and being connected to said tubular piercing member.

2. Device according to claim 1, characterized in that the lever comprises in the proximity of its part carrying the claw an insert made of plastic which is connected to the sealing collar and into which the tubular piercing member is firmly inserted by injection.

3. Device according to claim 2, characterized in that the insert contains a plug of the tap.

4. Device according to claim 1, characterized by a spacer with detent notch for shortening the effective length of the lever between the claw and detent notch.

5. Device according to claim 4, characterized in that an aerating spike is arranged on the spacer.

6. Device according to claim 1, characterized in that a handle is provided on the lever.

* * * * *